US005245803A

United States Patent [19]

Haag

[11] Patent Number: 5,245,803

[45] Date of Patent: Sep. 21, 1993

[54] CONNECTOR MEANS FOR ROOF PANELS AND A METHOD FOR INSTALLATION THEREOF

[76] Inventor: E. Keith Haag, 1007 W. Steels Corners Rd., Cuyahoga Falls, Ohio 44223

[21] Appl. No.: 792,356

[22] Filed: Nov. 14, 1991

[51] Int. Cl.[5] ..... E04B 1/38; E04B 7/00

[52] U.S. Cl. ..... 52/90.1; 52/92.1; 52/92.2; 52/95; 52/79.9; 52/262; 52/271; 52/283; 52/300; 52/699; 52/766; 52/743; 52/745.13

[58] Field of Search ..... 52/90, 73, 94, 95, 79.5, 52/79.9, 79.11, 79.13, 259, 260, 262, 263, 271, 272, 278, 283, 285, 289, 300, 761, 766, 699, 698, 743, 745.05, 745.13, 745.21, 582, 586, 284, 275, 91, 92, 127.11,

[56] References Cited

U.S. PATENT DOCUMENTS

| | | | |
|---|---|---|---|
| 1,998,448 | 4/1935 | Crowe . | |
| 2,261,510 | 11/1941 | Atcheson | 52/289 X |
| 2,467,115 | 4/1949 | Duggan | 52/699 |
| 2,850,771 | 9/1958 | Wagner . | |
| 2,918,151 | 12/1959 | Kennedy . | |
| 3,124,222 | 3/1964 | Mote | 52/94 X |
| 3,196,499 | 7/1965 | Houvener | 52/90 X |
| 3,229,431 | 1/1966 | Paul . | |
| 3,284,966 | 11/1966 | Bolt . | |
| 3,388,514 | 6/1968 | Archinal et al. . | |
| 3,397,494 | 8/1968 | Waring . | |
| 3,397,496 | 8/1968 | Sohns . | |
| 3,423,891 | 1/1969 | Burris . | |
| 3,436,881 | 4/1969 | Schlecht | 52/502 X |
| 3,452,498 | 7/1969 | Kinsey | 52/94 X |
| 3,641,720 | 2/1972 | Berrie | 52/122 |
| 3,662,507 | 5/1972 | Espeland . | |
| 3,738,083 | 6/1973 | Shimano . | |
| 3,783,563 | 1/1974 | Moore . | |
| 3,828,502 | 8/1974 | Carlsson . | |
| 3,866,381 | 2/1975 | Eschbach et al. . | |
| 3,992,839 | 11/1976 | LaBorde . | |
| 4,038,791 | 8/1977 | Atkinson | 52/73 X |
| 4,183,185 | 1/1980 | Farge . | |
| 4,557,091 | 12/1985 | Auer . | |

*Primary Examiner*—Carl D. Friedman
*Assistant Examiner*—Robert Canfield
*Attorney, Agent, or Firm*—Renner, Kenner, Greive, Bobak, Taylor & Weber

[57] ABSTRACT

Connector means embodying the concepts of the present invention are adapted to secure one or more roof panel members to a modular building structure. Broadly, such a connector means has a horizontally disposed base portion that is adapted to engage a supporting member incorporated in, and presented from, the modular building. An inclined, plate portion is supported from the base portion. The plate portion is adapted to receive, and support, the roof panel. A locking member frictionally secures each roof panel to one or more inclined plate portions.

11 Claims, 5 Drawing Sheets

CONNECTOR MEANS FOR ROOF PANELS AND A METHOD FOR INSTALLATION THEREOF

TECHNICAL FIELD

The present invention relates generally to modular building structures. More particularly, the present invention relates to connector means for modular building structures, the building structures to be constructed with a plurality of prefabricated structural components and being particularly adapted for use in third world countries. Specifically, the present invention relates to a novel connector means in the nature of an anchor assembly for securing roof panel members to a wall and a compatible connector means in the nature of a joinder assembly for securing roof panel members to each other at the ridge of the roof, the connector means being particularly adapted for use in conjunction a modular building structure such that the roof may be erected in a relatively short time with the simplest of tools, and without the need for craftsmen skilled in the building trades.

BACKGROUND OF THE INVENTION

It is well known in the construction industry that significant economic savings can be realized by reducing the amount of work required at the construction site. To achieve this objective, prefabrication has been adopted on a large scale in the construction industry, both with respect to general purpose buildings and with respect to personal housing. For example, some source have estimated that as many as forty percent (40%) of the homes now being built use some form of premanufactured structural components. Moreover, four and seven-tenths percent (4.7%) of all housing starts in the U.S. in 1991 are homes that are completely modular, and this percentage is expected to rise. The ultimate goal to be achieved in building modular structures has been to produce, at a remote site and in a factory environment, as many of the components of a given structure as possible, leaving only site preparation and final assembly to be done at the actual location where the building is to be situated.

There are a number of advantages to be achieved by prefabrication. The most obvious of those advantages is the significant reduction of time and labor required at the job site, where labor costs are normally the highest. In addition to the reduced time required for actual erection of the building, other time savings are also possible. For example, the reduced amount of work time at the job site reduces the potential for interruptions resulting from inclement weather. Reduced time at a job site can also drastically reduce the potential for work-related injuries and/or deaths. A controlled factory atmosphere is inherently amenable to measures for reducing injuries and increasing safety.

Furthermore, increased uniformity of the structural components resulting from the enhanced quality control possible in a factory atmosphere and the economic advantages of mass production techniques are also achievable with the prefabrication approach. As is often the situation, the use of standardized, prefabricated structural components not only improves the uniformity of the end product but also greatly simplifies the actual erection process. This last feature also makes it possible to produce quality buildings with unskilled, or minimally skilled, personnel. Thus, the overall results of prefabrication in the construction industry include greatly improved efficiency, significantly reduced costs, lower accident rates and better safety records.

These advantages are, of course desirable in any type of construction, but are believed to be especially important in the production of individual dwellings, particularly in economically distressed areas and in third world countries where cost is one of the most significant obstacles to overcome.

There are a wide variety of practical ways of to effectuate the prefabrication concept.

For example, the U.S. patent to Crowe—U.S. Pat. No. 1,998,448—discloses the factory prefabrication of steel frame panel units of standard dimensions which are filled with cementitious material and assembled so as to leave vertical spaces between adjacent vertical walls for utility connection and with laterally adjacent panels being joined by cover strips or slabs which are interconnected thereto.

The U.S. patent to Wagner—U.S. Pat. No. 2,850,771—discloses a prefabricated construction system wherein wooden panels are interconnected to vertical posts or columns with the vertical edges of the wooden wall panels and the posts having grooved areas and with spline blocks used to interconnect the two.

The U.S. patent to Paul—U.S. Pat. No. 3,229,431—is indicative of another approach wherein a so-called "frameless" modular multi-story building is constructed from self-contained prefabricated modules which are simply set on a building foundation and attached thereto by anchor bolts secured in the foundation.

The U.S. patent to Bolt—U.S. Pat. No. 3,284,966—is of general interest in showing a prefabricated building which can be readily assembled or erected at the job site and which is collapsible for transportation purposes.

The U.S. patent to Moore—U.S. Pat. No. 3,783,563—discloses a prefabricated building constructed of panels formed of molded plastic material, reinforced with glass fibers, and wherein the panels have channels or ribs on their edges adapted to mate with complementary structures of connector members.

Other examples of prefabricated construction components utilizing various plastic materials can be seen in the U.S. patent to Kennedy—U.S. Pat. No. 2,918,151; the U.S. patent to Espeland—U.S. Pat. No. 3,662,507; the U.S. patent to Sohns—U.S. Pat. No. 3,397,496; and, the U.S. patent to Farge—U.S. Pat. No. 4,183,185.

The foregoing patents are believed to be generally representative of the prior art, and that art does illustrate some diverse approaches to the prefabrication of building using various materials. However, none of the aforesaid prior art patents, nor any other prior art with which the inventor is aware, either alone or in combination, achieve the several objects of the present invention.

SUMMARY OF THE INVENTION

It is, therefore, a primary object of the present invention to provide an improved roof connector means for a modular building structure.

It is another object of the present invention to provide roof connector means, as above, which can be used structurally to join roof panel members to a supporting wall, and to join roof panel members to each other with relatively unskilled laborers, and without specialized tools.

It is a further object of the present invention to provide a roof connector means, as above, which permits the erection, and connection, of roof panel members to their supporting structure and to each other in a far shorter period of time than heretofore possible.

It is still another object of the present invention to provide a roof connector means, as above, which can be mass produced at relatively modest expense and can then be conveniently shipped to a remote construction site, also at relatively modest cost.

It is yet another object of the present invention to provide a roof connector means, as above, which permits roof panel members to be erected with a much reduced number of work-related injuries and/or deaths than with more traditional construction methods.

It is still further object of the present invention to provide a roof connector means, as above, a majority of the structural components for which may be prefabricated in a controlled working environment that inherently leads to reduced injuries and increased safety.

These and other objects of the invention, as well as the advantages thereof over existing and prior art forms, which will be apparent in view of the following detailed specification, are accomplished by means hereinafter described and claimed.

In general, a connector means embodying the concepts of the present invention is adapted to secure one or more roof panels to a modular building structure. Broadly, such a connector means has a horizontally disposed base that is adapted to engage a supporting member incorporated in the modular building. An inclined, plate portion is supported from the base. The plate portion is adapted to receive, and support, a roof panel. A locking member frictionally secures each roof panel to the inclined plate portion.

The present invention is described in conjunction with one exemplary embodiment of a roof-to-wall connector means and one embodiment of a roof-peak connector means which are deemed sufficient to effect a full disclosure of the subject invention. The exemplary connector means are described in detail without attempting to show all of the various forms and modifications in which the invention might be embodied; the invention being measured by the appended claims and not by the details of the specification.

DESCRIPTION OF AN EXEMPLARY EMBODIMENT

One representative form of a roof-to-wall connector means embodying the concepts of the present invention is designated generally by the numeral 10 on the accompanying drawings. The representative roof-to-wall connector means 10 may, for example, be employed in a building structure which could serve as residential living quarters.

Figure 1:
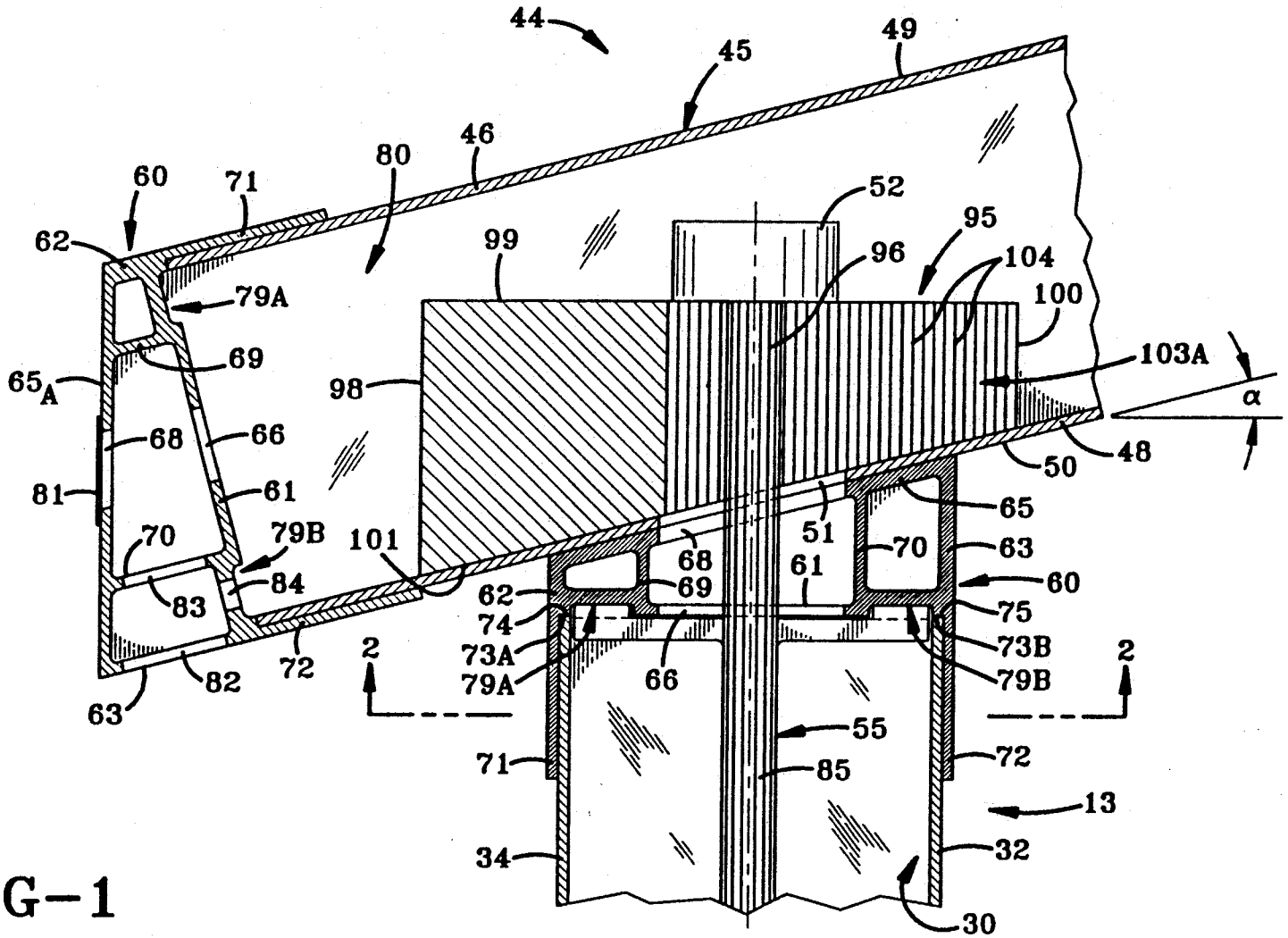
FIG. 1 is a vertical section through a roof-to-wall connection embodying the concepts of the present invention.
Figure 2:
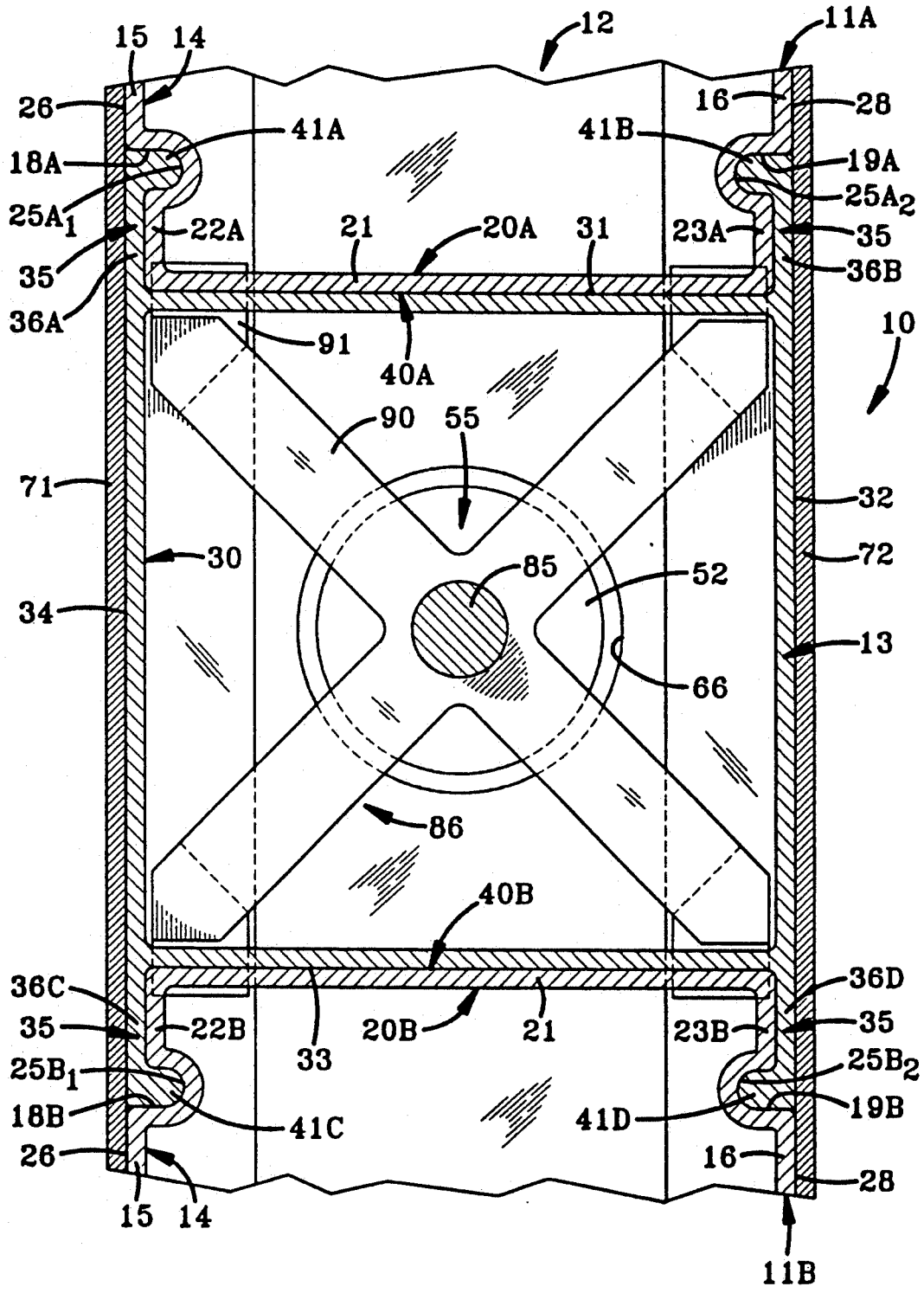
FIG. 2 is a horizontal section taken substantially along line 2—2 of FIG. 1 and looking upwardly at a portion of the structure by which the roof-to-wall connection is effected.

With particular reference to FIGS. 1 and 2, the composite structure which constitutes the principal component of the walls, and even the roof, of the modular structure for which the present connector means assembly is particularly suited is the panel member 11. That portion of the wall 12 represented in FIG. 2 is formed by two, longitudinally aligned panel members 11A and 11B which are joined by a panel connector 13.

As previewed in the previous paragraph, and as will appear in the detailed description which follows, a particular structural member, component or arrangement may be employed at more than one location. When referring generally to that type of structural member, component or arrangement a common numerical designation shall be employed. However, when one of the structural members, components or arrangements so identified is to be individually identified it shall be referenced by virtue of a letter suffix employed in combination with the numerical designation employed for general identification of that structural member, component or arrangement. Thus, there are at least two panel members which are generally identified by the numeral 11, but the specific, individual panels are, therefore, identified as 11A and 11B in the specification and on the drawings. This same suffix convention shall be employed throughout the specification.

Returning to the description of the arrangement depicted in FIG. 2, the wall panel members 11 each have a body portion 14. The body portion 14 has planar, transversely spaced, substantially parallel, skin walls 15 and 16. A plurality of reinforcing ribs, not shown, preferably extend transversely between the skin walls 15 and 16. The ribs are, themselves, laterally spaced, one with respect to the others, and they are oriented substantially parallel to the lateral edges of the body portion 14—i.e., perpendicularly with respect to the skin walls 15 and 16.

The longitudinal edges of the body portion 14 are delineated by positioning shoulders 18 and 19 presented at the opposite ends of each skin wall. As depicted in FIG. 2, a positioning shoulder 18A defines one longitudinal edge of skin wall 15 on panel 11A, and a corresponding, and laterally spaced, positioning shoulder 19A defines one longitudinal edge of skin wall 16 of panel 11A. The positioning shoulders 18A and 19A thus define one longitudinal edge of the body portion 14 on panel 11A as well as the offset juncture between the body portion 14 and the connecting tongue 20A which extends longitudinally outwardly from that vertical edge of the body portion 14 on panel 11A defined by the positioning shoulders 18A and 19A.

Similarly, a positioning shoulder 18B defines the opposite longitudinal edge of skin wall 15 on panel 11B, and a corresponding, and laterally opposed, positioning shoulder 19B defines the opposite longitudinal edge of wall skin 16 on panel 11B. The positioning shoulders 18B and 19B are laterally spaced from each other, and longitudinally opposed to the positioning shoulders 18A and 19A on panel 11A. As in panel 11A, the positioning shoulders 18B and 19B define one longitudinal edge of the body portion 14 on panel 11B as well as the offset juncture between the body portion 14 and the connecting tongue 20B which extends longitudinally outwardly from that longitudinal edge of the body portion 14 on panel 11B defined by the positioning shoulders 18B and 19B.

The connecting tongues 20 each have a transversely oriented closure wall 21 that is spaced longitudinally outwardly from the longitudinal edge of the body portion 14 defined by the positioning shoulders 18 and 19. The transverse edges of the closure wall 21 are joined to transversely spaced, longitudinally extending, locking walls 22 and 23. A vertically extending locking groove 25 is recessed into each connecting tongue 20 between each locking wall 22 and 23 and the body portion 14 such that locking grooves $25A_1$ and $25A_2$ lie parallel to shoulders 18A and 19A, respectively, of panel 11A. Similarly, locking grooves $25B_1$ and $25B_2$ lie parallel to shoulders 18B and 19B of panel 11B.

The pair of tongues 20A and 20B presented from the longitudinal edges of the linearly aligned panels 11A and 11B, respectively, have a transverse thickness that is less that the transverse thickness of the body portion 14 in either panel member 11.

Specifically, the locking walls 22 are laterally offset with respect to the longitudinally and vertically oriented plane within which the exposed surface 26 on skin wall 15 is disposed, and the locking walls 23 are laterally offset with respect to the longitudinally and vertically oriented plane within which the exposed surface 28 on skin wall 16 is disposed. It is these lateral offsets of the locking walls 22 and 23 relative to the respective surfaces 26 and 28 on the two skin walls 15 and 16 which results in the transverse, or laterally measured, thickness of the tongues 20 being less that the transverse, or laterally measured, thickness of the body portion 14 on either panel member 11A or 11B. The functional purpose for this deliberate disparity between the transverse thickness of the tongues 20 relative to the transverse thickness of the body portion 14 in each panel member 11 accommodates the panel connector 13, as will now be explained.

With continued reference to FIG. 2, the panel connector 13 is employed to effect a structural tie between the two, linearly oriented panel members 11A and 11B. Typically, a panel connector 13 has a body portion 30 that is preferably of box-shaped cross section. That is, the body portion 30 is hollow and has a generally rectilinear, external periphery which defines a plurality of exterior faces such as the four 31, 32, 33 and 34 depicted. The box-shaped cross section provides excellent bending strength with minimal material as well as excellent columnar strength with a superb L/R ratio.

Connecting flanges 35 are presented from the body portion 30 in oppositely extending pairs. Each flange 35 has an extension arm 36 with ends that are proximal and distal with respect to the body portion 30 from which each extension arm 36 is presented. The proximal end portion of each extension arm 36 is integral with the body portion 30 in such a manner that each extension arm is oriented in perpendicular relation with respect to one adjacent face but also in longitudinal alignment—i.e.: coplanar—with another face on the body portion 30.

As can be seen with reference to FIG. 2, the extension arm 36A is oriented not only in perpendicular relation with respect to the exterior face 31 but also in coplanar relation with respect to exterior face 34. Likewise, the extension arm 36B is oriented not only in perpendicular relation with respect to the exterior face 31 but also in coplanar relation with respect to the exterior face 32. The extension arms 36A and 36B are thus disposed in transversely spaced, parallel relation to form the first connection receptacle 40A.

A locking pawl 41 extends transversely outwardly from the distal end portion of each extension arm 36. Specifically, locking pawl 41A is presented from the distal end portion of the extension arm 36A, and pawl 41B is presented from the distal end portion of the extension arm 36B. The pawls 41A and 41B so provided extend toward each other in facing opposition in the first connection receptacle 40A.

The panel connector 13 also presents a second pair of extension arms 36C and 36D which extend outwardly from the body portion 30 in a diametrically opposite direction relative to the first pair of extension arms 36A and 36B, respectively. As such, the extension arm 36C is oriented not only in perpendicular relation with respect to the exterior face 33 but also in coplanar relation with respect to the exterior face 34. Likewise, the extension arm 36D is oriented not only in perpendicular relation with respect to the exterior face 33 but also in coplanar relation with respect to the exterior face 32. The extension arms and 36C and 36D are thus disposed in transversely spaced, parallel relation to form the second connection receptacle 40B which extends longitudinally outwardly from the panel connector 13 in the diametrically opposite direction from connection receptacle 40A.

A locking pawl 41C also extends transversely outwardly from the distal end portion of extension arm 36C, and a locking pawl 41D extends transversely outwardly from the distal end of extension arm 36D. The locking pawls 41C and 41D thus also extend toward each other in facing opposition within the connecting receptacle 40B.

The heretofore defined wall panel members 11 and the panel connectors 13 permit the wall 12 to be either directly assembled in their final, vertical disposition, or assembled at ground level and then raised into their final, vertical position. Either approach is acceptable, but there will likely be those who prefer one method over the other.

To erect a wall 12 in situ at least one laborer will require a ladder, stilts or some form of scaffolding. In this situation two sequential panel members 11A and 11B may be positioned in linear juxtaposition, and the laborer on the scaffolding, or the like, may take a coupling connector 13 and slide it vertically between the linearly juxtaposed panel members 11A and 11B such that, as depicted in FIG. 2, the connecting receptacle 40A on the panel connector 13 operatively engages the connecting tongue 20A on panel 11A and the connecting receptacle 40B on the panel connector 13 operatively engages the connecting tongue 20B on panel member 11B.

Operative engagement of the connecting receptacles 40 on the panel connector 13 with the tongues 20 on the panel members 11 requires that the locking pawls 41 in the connection receptacles 40 mesh with the locking grooves 25 associated with each the connecting tongue 20. In fact, the locking pawls 41 are slidably received within the locking grooves 25. So engaged, the panel member 11A and 11B are fully tied to the panel connector 13, and thus to each other.

Continued reference to FIG. 2 will also reveal the functional purpose of having the connecting tongues 20 of lesser transverse thickness than the thickness of the body portion 14 of the panel members 11 from which the tongues 20 are presented. By making the trnasverse offset between each locking wall 22 and 23 and the appropriate skin wall 15 or 16 on the panel members 11 equal to the transverse thickness of the extension arm 36 of the panel connector 13, the faces 34 and 32, respectively, on the body portion 30 of the panel connector 13 will be located coplanar with the surface of the skin walls 15 and 16 on the panel members 11. With all the transverse offsets between the skin walls 15 and 16 on the panel members 11 and the corresponding locking walls 22 and 23 on the connecting tongues 20 being so dimensioned, both sides of the wall 12 defined by the skin walls 15 and 16 on successive panel members 11 across the length of the wall 12 will be virtually flush with each other and with the appropriate faces 34 and 32 on the panel connectors 13 used to interconnect the panel members 11.

The panel members 11, as well as the panel connectors 13 described above, as well as those structural members which will be hereinafter described, may well comprise an extruded thermoplastic resin. Such resins are preferably reinforced with fibers such as fiberglass and provide a material commonly referred to as a fiber-reinforced plastic (FRP). While a variety of thermoplastic materials and fiber reinforcements are known, one particularly suitable FRP comprises vinyl chloride resins reinforced with glass fibers.

The amount of fiber reinforcement in such a product can range: broadly from about five to fifty percent (5% to 50%) by weight, based upon the combined weight of glass fibers and vinyl chloride resin; desirably from about ten to forty percent (10% to 40%) by weight; preferably about fifteen to thirty-five percent (15% TO 35%) by weight; and, most preferably about thirty percent (30%) by weight. A good disclosure of these products and the process for their preparation can be found in U.S. Pat. No. 4,536,360, the subject matter of which is incorporated herein by reference.

As should be evident to those skilled in the art, practice of the present invention does not require that the structural components comprise vinyl chloride resins reinforced by glass fiber and therefore, the invention is not to be limited thereto or by the disclosure of U.S. Pat. No. 4,536,360. Thus, the structural components may not be fiber reinforced or even thermoplastic so long as they can be manufactured in the configurations described herein.

As noted previously, composite panel members 11 may also constitute the principal component of the roof. To preclude confusion the panel members shall, when used as a component of the roof itself, be designated by the numerical identifier 45. The roof panel members 45 are, as depicted in FIG. 1, connected to, and supported by, the wall 12, the structural arrangement for which has now been described. The roof panel member 45 also has opposed skin walls 46 and 48, skin wall 46 presenting the exterior surface 49 of the roof panel 45, and skin wall 48 presenting that surface 50 which faces interiorly of the structure covered by the roof panel members 45.

With additional reference to FIG. 1 it will be observed that an aperture 51 penetrates the skin wall 48 presenting the interior surface 50 on the roof panel member 45. The aperture 51 is of sufficient dimension to be readily received over the locking head 52 of an anchor dowel 55, as will be hereinafter described in greater detail.

As can be seen from FIG. 1, an end cap 60 serves to determine the pitch at which the roof panel member 45 is inclined with respect to the vertically disposed wall 12. Each end cap 60 has a horizontal base 61, and a vertically oriented, short riser 62 is conjoined to the base 61 at approximately the outer extent of the base 61. A vertically oriented, long riser 63 is similarly conjoined at the inner extent of the base 61. The difference in the vertical extent of the risers 62 and 63 determines the pitch at which the roof panel member 45 is inclined, as should now be apparent. An inclined plate portion 65 is disposed in spaced relation upwardly of the base 61 and may be integral with the risers 62 and 63.

The base 61 and the inclined plate portion 65 are each provided with respective apertures 66 and 68. The apertures 66 and 68 are aligned and are also of sufficient dimension to permit the locking head 52 of the anchor dowel 55 to be received therethrough. Reinforcing walls 69 and 70 extend substantially be received therethrough. Reinforcing walls 69 and 70 extend substantially vertically between the base 61 and the inclined plate portion 65, and they are preferably disposed in parallel relation to the risers 62 and 63. Although only two reinforcing walls 69 and 70 are depicted in the drawings, it should be understood that the space which extends vertically between the apertures 66 and 68 may be surrounded by reinforcing walls in order to provide additional strength to the end cap 60, if required, or desired.

A pair of mounting flanges 71 and 72 extend downwardly from the base 61, and they are preferably disposed in alignment with the risers 62 and 63, respectively, and are laterally spaced contiguously to engage the surfaces 34 and 32 on the body portion 30 of the panel connector 13 as well as the exposed surfaces 26 and 28 (FIG. 2) on the skin walls 15 and 16 of each panel member 11. As such, the end cap 60 embracingly engages the wall panels 11A and 11B, as they are conjoined by the panel connector 13, as well as the panel connector 13 itself.

At the juncture of each mounting flange 71 and 72 with the base 61 is an engaging step 73. When the end cap 60 is received on the panel member(s) 11 forming the wall 12, the steps 73A and 73B engage the upwardly directed edges 74 and 75, respectively, of the walls 34 and 32 on the connector 13 as well as the upwardly directed edges 76 and 78 (FIG. 4) of the coplanar walls 15 and 16 on the wall panel members 11. The steps 73 thus serve to effect accurate placement of the end cap 60 with respect to the wall 12 on which it is received.

A pair of longitudinally extending recesses 79A and 79B are formed in the base 61. The recesses 79A and 79B may, as represented, be respectively disposed in proximity to the engaging steps 73A and 73B. The recesses 79 serve to align, and position, the anchor dowel 55, as will be hereinafter more dully explained.

The utilization of one component for multiple purposes also enhances the concept of modularity. An excellent example of this multiple utilization is that the end cap 60 can not only be employed along the upper extent of the panel members 11 forming the wall 12 but also along the outer edge of the roof panel members 45 which form the roof 44, where the plate portion 65 becomes the fascia $65_A$ (FIG. 1). The apertures 66 and 68 which accommodate the locking head 52 of the anchor dowel 55 then serve as ventilation openings to the interior cavity 80 of the roof panel 45. In that situation at least the outer aperture 68 may be provided with a screen 81, or other means, by which to preclude the admission of bugs, birds or rodents. To provide a means by which to drain any undesired liquid from accumulating within the cavity 80, apertures 82 and 83 may penetrate the long riser 63 and the reinforcing wall 70, respectively, and an aperture 84 may penetrate the base 61 and open through the recess 79B adjacent the long riser 70.

Figure 4:
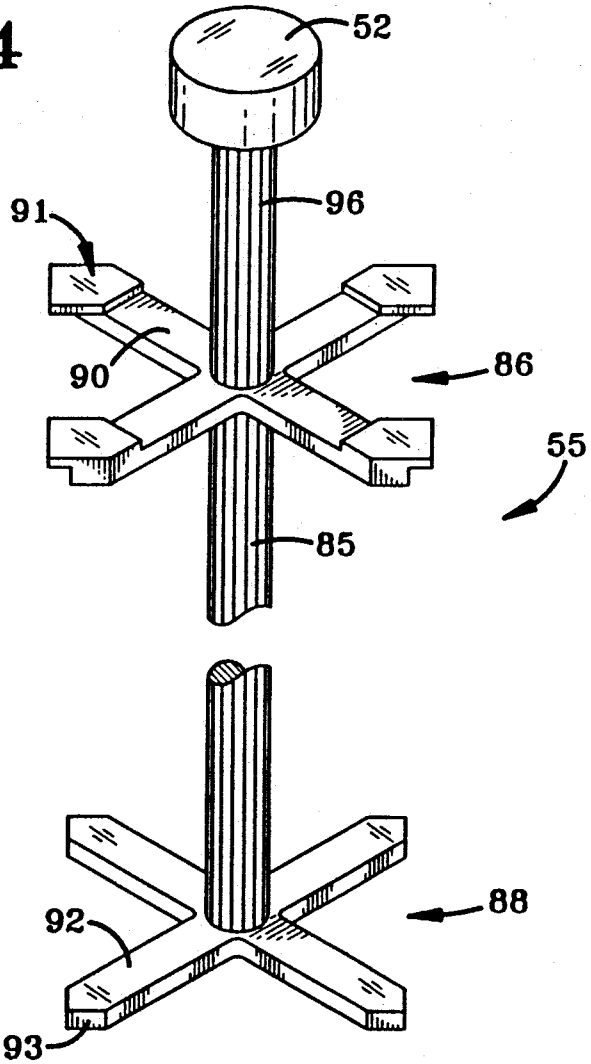
FIG. 4 is a perspective view of one form of an anchor dowel employed as a component of the roof-to-wall connection embodying the concept of the present invention.

Returning to the description of the roof-to-wall connector arrangement, the anchor dowel 55 is a generally cylindrical structure, having a cylindrical body portion 85 the upper extent of which terminates in a locking head 52 which has at least one transverse dimension that is greater than a corresponding transverse dimension of the body portion 85. As best seen in FIG. 4, the body portion 85 as well as the locking head 52 may both be cylindrical.

Figure 3:
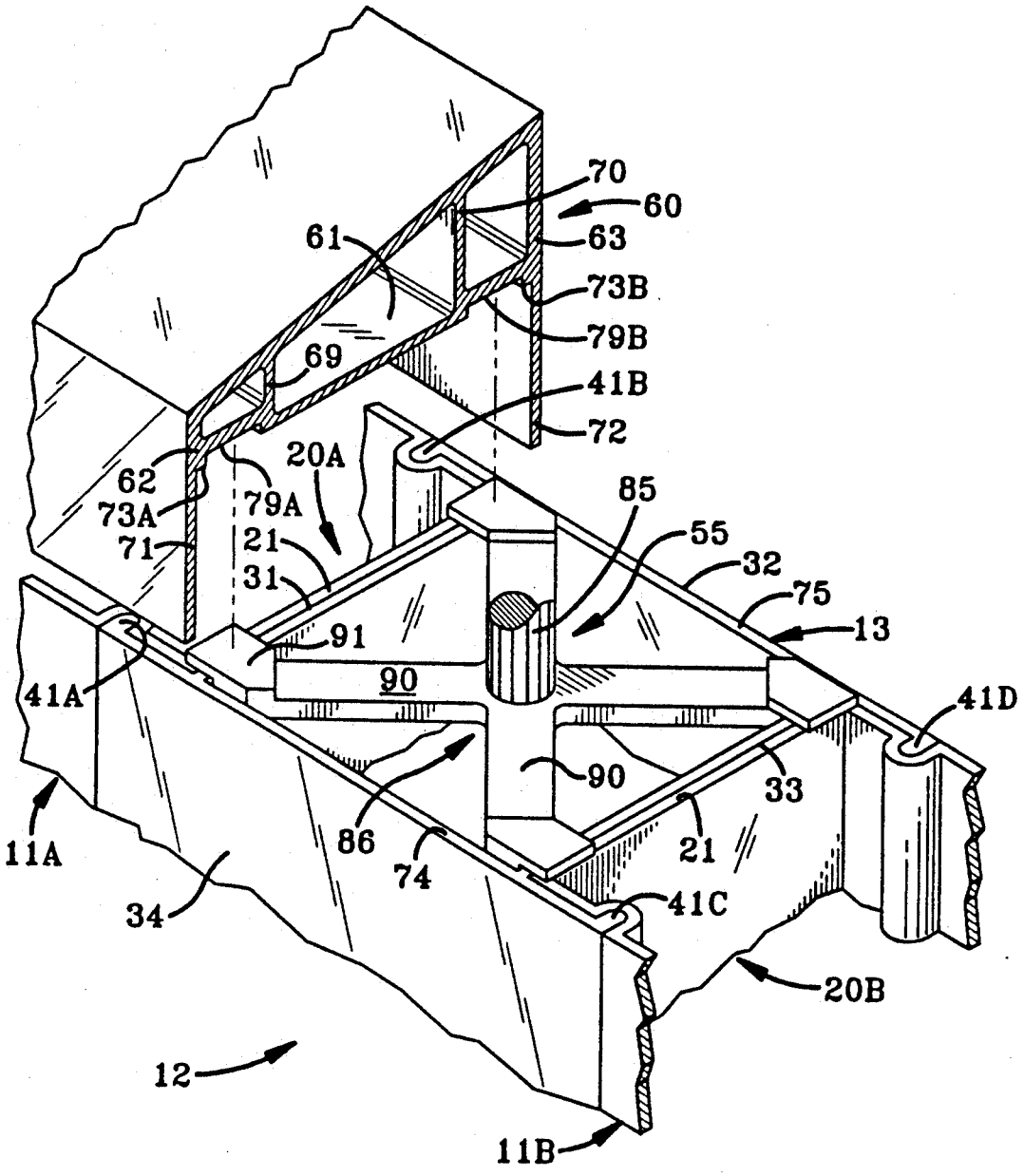
FIG. 3 is an exploded perspective of the roof-to-wall connection depicted in FIGS. 1 and 2 which is presented to depict the structural interaction between the components forming that connection.

The anchor dowel 55 has two positioning arrays, a vertically upper array 86, and a lower array 88, which assure that the body portion 85 is located centrally with respect to the cavity 89 (FIGS. 1 and 3) within the connector 13. The upper array 86 may employ four individual arms 90 which extend radially outwardly from the body portion 85, each of which terminate in an engaging tab 91. The arms 90 are preferably spaced at angular increments of 90 degrees about the circumference of the body portion 85, and each engaging tab 91 is angularly disposed with respect to the axis of the arm 90 from which it is presented so as to engage one of the recesses 79A or 79B (FIGS. 1-3) formed in the end cap 60. The engaging tabs 91 also fit between the base 61 (within the appropriate recess 79) of the end cap 60 and the closure wall 21 of the appropriate tongue 20.

Figure 5:
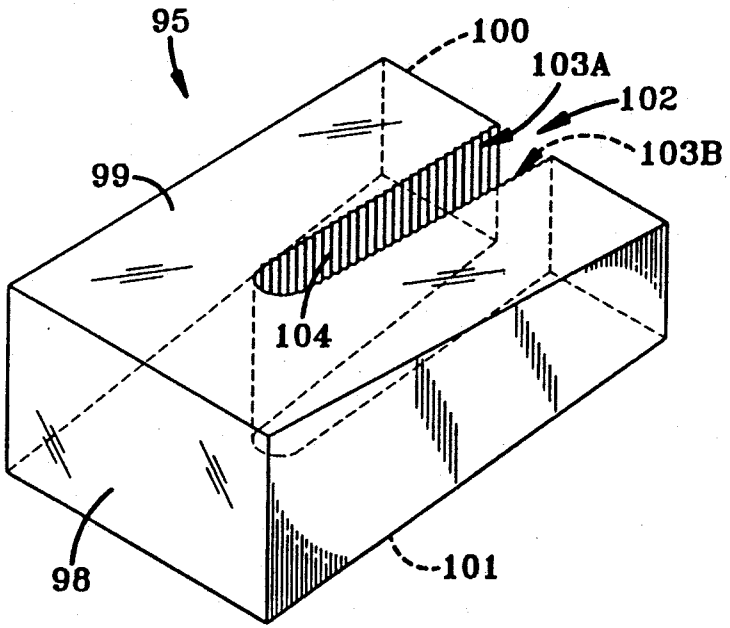
FIG. 5 is a perspective representation of one form of an anchor block employed in the roof-to-wall connection of the present invention.

The lower array 88 may also employ four individual arms 92 (FIG. 4) which extend radially outwardly from the body portion 85, each of which terminate in an engaging wedge 93. The arms 92 are also preferably spaced at angular increments of 90 degree about the circumference of the body portion 85. The engaging wedges 93 are each received within the included angle formed by the intersection of the sides 31, 32, 33 and 34 forming the body portion 30 of the panel connector 13. The lower array 88 is preferably located at the very bottom of body portion 85. The vertical distance between the upper and lower arrays 86 and 88 may be selected to assure that the lower array 88 may be buried to a sufficient extent within whatever cementitious material is introduced into the cavity 89 of the connector 13 in order to provide the desired resistance against lifting of the roof structure off the supporting wall 12 and also to permit a close fit between the end cap 60 and the components of the upper array 86. When those conditions are met, the vertical distance between the upper array 86 and the locking head 52 will accommodate an anchor block 95 (FIGS. 1 and 5) which is interposed between the locking head 52 and the plate portion 65 of end cap 60 to tie the roof panel 45 to the wall 12, as will be hereinafter described in greater detail. The surface on that length of the anchor dowel body portion 85 which extends between the locking head 52 and the plate portion 65 of the end cap 60 is preferably provided with vertical striations 96 cooperatively to interact with an anchor block 95, as will be hereinafter more fully described.

The anchor block 95 is generally wedge shaped, with a trapezoidal, vertical cross-section as best seen in FIG. 1. Three sides of this trapezoidal cross-section—i.e.: sides 98, 99 and 100—are perpendicular to each other, but the remaining side 101 is inclined at angle equal to the pitch $\alpha$ of the roof 44. The anchor block 95 has a central slot 102 which opens through side 100. The lateral sides 103A and 103B of the slot 102 has vertical striations 104 which are lockingly engageable with the striations 96 on the body portion 85 of the anchor dowel 55.

As should now be readily understood, when the anchor dowel 55 is secured within the connector 13 the locking head 52 and a length of the body portion 85 will extend upwardly through the aperture 68 in the plate portion 65 so that an aperture 51 in the skin wall 48 of the roof panel 45 can be received over the locking head 52. When the interior surface 50 on the skin wall 48 thus contiguously engages the plate portion 65, an anchor block 95 will be inserted into the cavity 80 of the roof panel 45 (the end cap 60 not yet having been positioned on the roof panel 45). A workman need only position the slot 102 in alignment with that length of the body portion 85 which extends into the cavity 80 of the roof panel 45 and then drive the anchor block 95 wedgingly between the locking head 52 and the plate portion 65. The interaction of the striations 96 on the body portion 85 of the anchor dowel 55 and the striations 104 on the anchor block 95 maintains the wedging action of the anchor block 95 and thereby secures the roof panel 45 to the wall 12.

The end cap 60 may then be applied to the roof panel 45. As shown in FIG. 1, the end cap 60 may be applied by fitting the mounting flanges 71 and 72 embracingly to engage the skin walls 46 and 48 on the roof panel 45. The end cap 60 may be retained by an adhesive or other fastening means.

Figure 6:
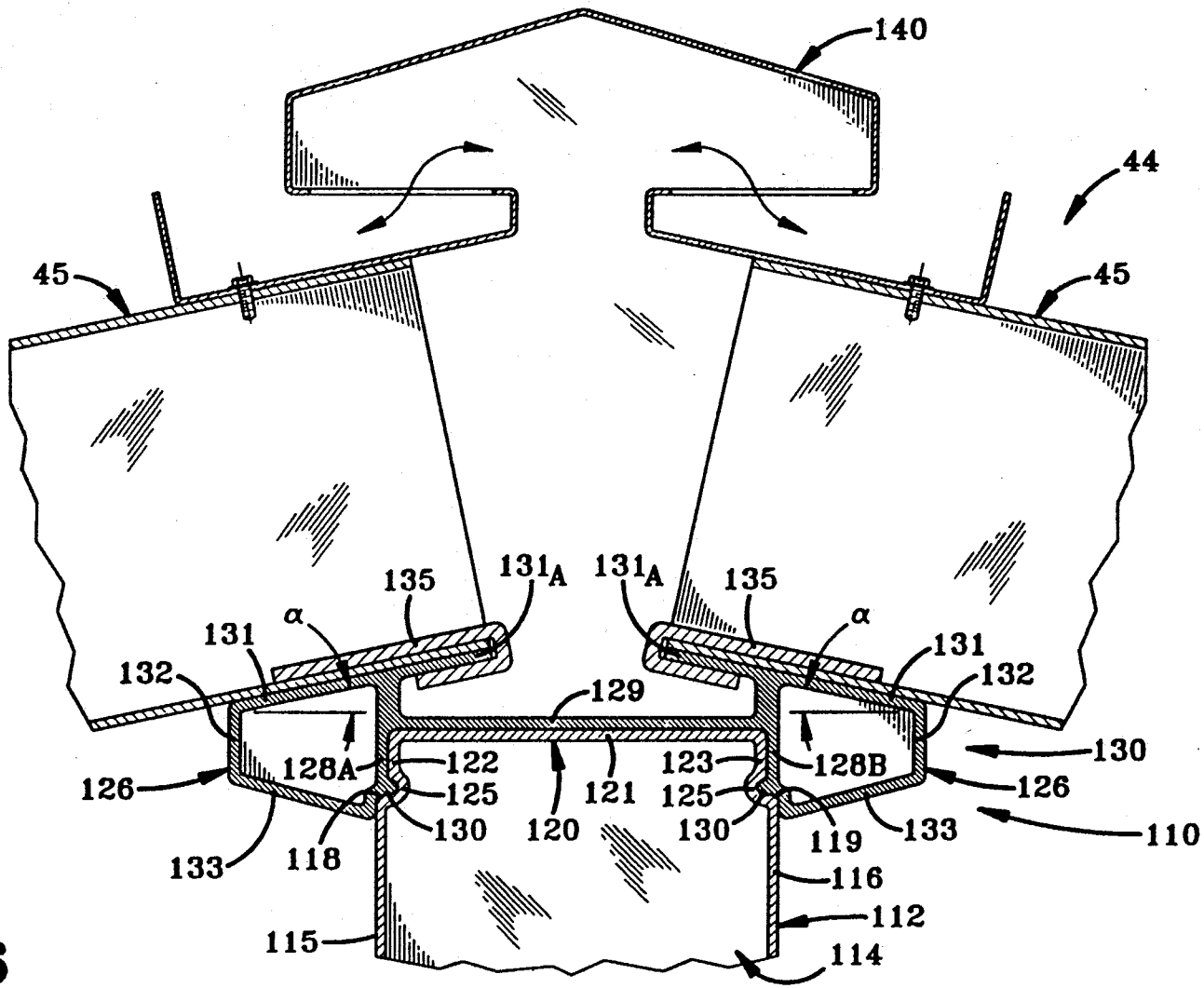
FIG. 6 is a vertical section through an exemplary roof-peak connection embodying the concepts of the present invention.

A roof-peak connector means adapted to close, and join, the roof panels 45 at the apex of the roof 44 is designated generally at 110 in FIG. 6. The roof-peak connector means 110 may employ a ridge beam 112. The ridge beam 112, like the wall panel members 10, also has a body portion 114 with transversely spaced, substantially parallel, skin walls 115 and 116, with at least the upper edge of each skin wall 115 and 116 terminating in positioning shoulders 118 and 119, respectively. A tongue 120 extends vertically upwardly from the positioning shoulders 118 and 119, which define the offset juncture between the body portion 114 of the ridge beam 112 and the tongue 120.

The tongue 120 also has a transversely oriented closure wall 121 that is spaced vertically upwardly from the longitudinally extending positioning shoulders 118 and 119. The transverse edges of the closure wall 121 are joined to transversely spaced, vertically disposed, and longitudinally extending, locking walls 122 and 123. Longitudinally extending locking grooves 125 are recessed into the connecting tongue 120 between each locking wall 122 and 123 and the reactive shoulders 118 and 119.

The tongue 120 may also have a transverse thickness that is less than the transverse thickness of the body portion 114. This offset may be accomplished in the same manner as the offset is accomplished in the wall panel members 11 previously described.

A ridge cap 130 is provided which cooperatively engages the tongue 120 on the ridge beam 112. The ridge cap 130 has a pair of laterally spaced brace members 126 that may, as shown have trapezoidal cross sections. The central portions of one parallel side 128, preferably the longest, on each trapezoid are conjoined by a horizontal web in the nature of a base 129. The base, or web, 129 overlies the closure wall 121 of the tongue 120, and a longitudinally extending locking pawl 130 projects outwardly from the one parallel side 128 of each brace member 126 to be received within each locking groove 125. The parallel sides 128A and 128B thus serve to embrace the tongue 120 of the ridge beam 112.

The upper, or plate, wall 131 presented from the brace member 126 is inclined at the pitch angle $\alpha$ of the roof 44, but the other parallel wall 132 as well as the exposed side wall 133, respectively, may be disposed in whatever is deemed by the user to be aesthetically pleasing. In the representative embodiment depicted the exposed side wall 133 is inclined at the same angle $\alpha$ as the plate wall 131. As shown, the plate walls 131 may each be provided with an extension $131_A$ which projects past the one parallel side 128 of each brace member 126.

Spring clips 135 may be used to secure the roof panels 45 to the appropriate extension $131_A$ on each brace member 126, and a ridge vent 140, as is well known to the art, may be used to cover the gap between the roof panels 45 at the apex of the roof. The ridge vent 140 does not form a part of the present invention.

As should now be apparent, the present invention not only teaches that a roof anchor embodying the concepts of the present invention provides a means by which to secure a roof to a wall with mass produced structural components that can be utilized by unskilled labor without special tools. By employing the concepts of the present invention the roof can be erected and secured in place and in a far shorter time than the same job could be accomplished by traditional components and skilled labor. It should now also be apparent that the other objects of the present invention are likewise accomplished.

I claim:

1. A connector means securing a roof panel to a wall in a modular building structure, the roof panel having a central cavity bounded by opposed, generally planar, skin walls, the central cavity being accessible from one end of the roof panel, an aperture penetrating one of the skin walls to provide additional access to the cavity, said connector means comprising:

an end cap;

a base presented from said end cap, said base adapted to rest upon a portion of the wall in the modular building;

said end cap also having an inclined plate portion upon which the roof panel may be supported;

an anchor dowel means received in, and being secured against movement relative to, the wall;

said anchor dowel means projecting upwardly through said end cap;

a locking head presented from said anchor dowel means upwardly of said plate portion in said end cap and being received through the aperture in said one of the skin walls of the roof panel;

an anchor block wedgingly inserted between said locking head and said plate portion frictionally to capture the skin wall of the roof panel penetrated by the aperture between said anchor block and said plate portion; and, means to maintain said anchor block wedgingly positioned between said locking head and said plate portion.

2. A connector means, as set forth in claim 1, wherein said anchor dowel means further comprises:

upper and lower positioning arrays;

said upper positioning array interacting with said end cap and the wall in which said end cap is received; and, said lower positioning array providing means by which to secure said anchor dowel means within the wall.

3. A connector means, as set forth in claim 1, wherein said anchor dowel means further comprises:

a cylindrical body portion adapted to extend within the cavity of the roof panel through the aperture;

said locking head having a greater dimension transversely of said cylindrical body portion than the diameter of said cylindrical body portion;

generally vertical striations presented on the body portion of said anchor dowel means;

said anchor block being tapered from a first wall to a second, opposite wall in order to present a wedge-like cross section;

a slot opening through said second wall and extending toward said first wall;

said slot having an inner surface;

vertical striations presented on the inner surface of said slot cooperatively to engage the striations on the body portion of said anchor dowel means in order fixedly to maintain said anchor block in engagement with said body portion of said anchor dowel means when said body portion of said anchor dowel means is received within said slot.

4. An assembly securing a roof panel member to a wall of a modular building structure, said assembly comprising:

a plurality of wall panel members;

said wall panel members being linearly conjoined by a panel connector to form a wall of the modular building structure;

each said panel connector having a preferably rectangular, interior cavity as well as means to effect a structural connection between linearly oriented wall panel members;

an anchor dowel means received in the interior cavity of said panel connector;

an end cap;

a base portion presented from said end cap;

said end cap positioned over said wall with said base portion resting on an upper extent of the wall panel members and the panel connectors which form a wall of the modular building structure;

at least one roof panel member;

said roof panel member having a central cavity bounded by opposed, generally planar, skin walls;

said central cavity being accessible from at least one end of the roof panel;

an aperture penetrating one of the skin walls;

said end cap also having an inclined plate portion upon which at least one said roof panel member may be supported;

means to secure said anchor dowel means against movement relative to the interior cavity of said panel connector within which said anchor dowel means is received;

said anchor dowel means projecting upwardly through said end cap;

a locking head presented from said anchor dowel means upwardly of said plate portion of said end cap and being received through said aperture in said one of said skin walls of the roof panel member;

an anchor block wedgingly inserted between said locking head and said plate portion frictionally to capture said one of said skin walls of the roof panel member penetrated by the aperture between said anchor block and said plate portion; and, means to maintain said anchor block wedgingly positioned between said locking head and said plate portion.

5. An assembly, as set forth in claim 4, wherein said anchor dowel means further comprises:

a cylindrical body portion extending into the central cavity of the roof panel through said aperture;

said locking head having a greater dimension transversely of the cylindrical body portion than the diameter of the cylindrical body portion;

generally vertical striations presented from the cylindrical body portion of said anchor dowel means;

said anchor block being tapered from a first wall to a second, opposite wall in order to present a wedge-like cross section;

a slot opening through said second wall and extending toward said first wall;

said slot having an inner surface;

vertical striations presented on said inner surface of said slot cooperatively to engage the striations of the cylindrical body portion of said anchor dowel means in order fixedly to maintain said anchor block in engagement with said cylindrical body portion of said anchor dowel means when said cylindrical body portion is received within said slot.

6. An assembly, as set forth in claim 5, wherein said anchor dowel means further comprises:

upper and lower positioning arrays;

said upper positioning array interacting with the interior cavity of said panel connector in which said end cap is received; and, said lower positioning array providing means by which to secure said anchor dowel means within said panel connector.

7. An assembly, as set forth in claim 6, wherein the upper positioning array on said anchor dowel means further comprises:

at least one pair of opposed, individual arms extending outwardly of said cylindrical body portion of said anchor dowel means;

each of said individual arms terminating in an engaging pad;

said engaging pads being interposed between said end cap and at least said panel connector in order precisely to locate said anchor dowel means.

8. An assembly, as set forth in claim 7, wherein the lower positioning array on said anchor dowel means further comprises:

at least one pair of opposed, individual arms extending outwardly of said cylindrical body portion of said anchor dowel means;

each of said individual arms terminating in a wedge, said wedge adapted to engage said wall panel connector further to effect accurate positioning of said anchor dowel means within said panel connector.

9. An assembly, as set forth in claim 8, wherein:

a cementitious material is received within the interior cavity of said wall panel connector to encapsulate said lower positioning array and thereby secure said anchor dowel means within said panel connector.

10. A method for erecting and connecting roof panels to a modular building structure comprising the steps of:

installing an anchor dowel means within a vertically oriented cavity provided in a wall of a modular building structure;

pouring a cementitious material around said anchor dowel within said vertically oriented cavity, thereby rigidly fixing said anchor dowel within the wall;

positioning an end cap having a lower base member and an upper plate portion over a vertically upper extent of the wall such that the lower base member engages the wall with the upper plate portion of the anchor dowel means extending upwardly through the plate portion of the end cap;

resting a roof panel member on the plate portion of the end cap with an upper portion of the anchor dowel means extending through one wall of the roof panel into an interior cavity of the roof panel member;

positioning an anchor block within an interior cavity of the roof panel; and, driving the anchor block into locking engagement with the anchor dowel means to secure the roof panel to the plate portion of the end cap and thus to the wall.

11. A method for erecting and connecting roof panels to a modular building structure, as set forth in claim 10, comprising the further steps of:

supporting a roof-peak connector means from a ridge beam;

resting the roof panel on a second plate portion presented from the roof-peak connector means; and, securing the roof panel to the second plate portion of the roof-peak connector means.

* * * * *